United States Patent [19]

Tyler et al.

[11] 4,451,873

[45] May 29, 1984

[54] REFLECTOR FOR A SEALED BEAM LAMP

[75] Inventors: David O. Tyler, Anderson; George M. Gasparovic, Pendleton, both of Ind.

[73] Assignee: General Motors Corporation, Detroit, Mich.

[21] Appl. No.: 362,617

[22] Filed: Mar. 29, 1982

Related U.S. Application Data

[63] Continuation-in-part of Ser. No. 128,674, Mar. 10, 1980.

[51] Int. Cl.[3] ..... F21V 29/00

[52] U.S. Cl. ..... 362/267; 313/113; 362/285; 362/287; 362/296; 362/307; 362/308; 362/309; 362/310; 362/362

[58] Field of Search ..... 313/113; 362/267, 285, 362/287, 296, 307, 308, 309, 310, 362

[56] References Cited

U.S. PATENT DOCUMENTS

| | | | |
|---|---|---|---|
| 4,241,391 | 12/1980 | Pitkjaan et al. | 362/267 |
| 4,259,712 | 3/1981 | Vodicka | 362/310 |
| 4,300,189 | 11/1981 | Shanks | 362/267 |
| 4,336,578 | 6/1982 | Bradley et al. | 362/310 |
| 4,339,790 | 7/1982 | Hanson et al. | 362/267 |

*Primary Examiner*—Stephen J. Lechert, Jr.
*Attorney, Agent, or Firm*—Edward J. Biskup

[57] ABSTRACT

A reflector for supporting a tungsten-halogen lamp assembly having a light bulb connected to a plurality of terminals. The reflector includes a parabolic section the rear central portion of which is integrally formed with a boss. At least two slots are formed in the boss for receiving the terminals, and each slot is located in a cavity which is adapted to be filled with an adhesive for fixing the terminals to the reflector after the lamp assembly is optically aimed.

3 Claims, 7 Drawing Figures

REFLECTOR FOR A SEALED BEAM LAMP

This is a continuation in part of Ser. No. 128,674, filed Mar. 10, 1980.

The present invention relates to a reflector for a sealed beam lamp construction which eliminates the need for grinding aiming points by enabling aiming simultaneously with adjustment of the light source filaments with respect to the reflector.

Sealed beam tungsten-halogen lamps are currently available in which the bulb filament support wires are secured to lead-in wires which are in turn brazed or soldered into electrically conducting ferrules sealed on the glass ferrule bosses formed on the rear of the reflector, electrical terminals being soldered on the outer end of each of the ferrules, all as shown in U.S. Pat. No. 4,146,812 issued Mar. 27, 1979 to Gagnon. In assembly of the patented lamp, the bulb is manipulated in the reflector by means of the lead-in support wires extending through the reflector to establish its proper location with respect to the reflector after which the lead-in support wires are soldered to the ferrules and terminals and the excess length of support wire is clipped off. The aim of the lamp is established by means of the conventional lens aiming pads.

The present invention concerns a reflector designed to enable the simultaneous aim of the lamp and adjustment of the bulb filament in the three axes with respect to the reflector so as to obtain the desired optical pattern, the structure lending itself to high production processing by permitting the manipulation of the light bulb, e.g., a tungsten-halogen bulb, from the rear of and outside the reflector-lens envelope to simultaneously compensate for the variations between reflectors, light sources, and lenses.

Accordingly, it is an object of our invention to provide a new and improved reflector for a sealed beam lamp in which the light bulb may be readily positioned from the rear of the reflector to locate the light source with respect to the reflector and the lens so as to obtain the desired pattern of light therefrom.

It is a further object of our invention to provide a new and improved reflector for a lamp which enables the use of simple production processing to obtain a sealed beam lamp having the filaments of a light bulb positioned with respect to the reflector to obtain the optimum light pattern, the aim of the lamp being achieved without the need for grinding the conventional aiming pads while compensating for variations between individual reflector, lens and light source parts.

These and other objects of our invention are obtained by providing a reflector for a tungsten-halogen sealed beam lamp characterized in that the rear central portion of the reflector is provided with a plurality of openings sized so as to accommodate the terminals of the light source assembly and allow pivotal movement thereof during aiming of the light source assembly. The terminals of the light source assembly are adapted to extend through the openings formed at the rear portion of the reflector, to allow adjustment of the light source assembly with respect to the reflector in the X-Y-Z axes. Optimum location of the light source assembly with respect to the reflector is achieved by manipulating the light source assembly from the rear of and outside the lamp envelope thus simultaneously compensating for variations between light sources, reflectors and lenses, the light source assembly being then sealed in the reflector by a sealing adhesive, e.g., epoxy or other resin, which is deposited into the cavity in the reflector surrounding the terminals.

Our invention is more fully described herefollowing and in the drawings in which FIG. 1 is a partially sectioned top view of a sealed beam headlamp having a reflector made in accordance with our invention;

Figure 1:
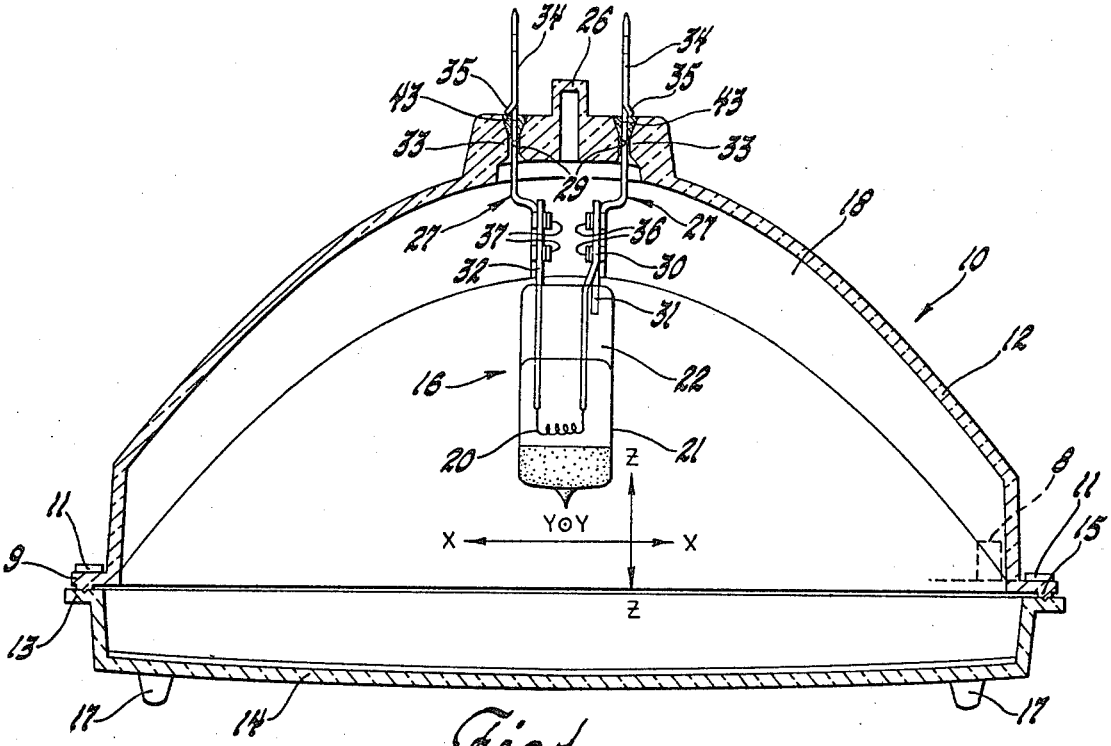

Referring now to FIG. 1, there is shown a rectangular sealed beam lamp 10 of the type commonly used for motor vehicle headlamps. The lamp 10 comprises a reflector 12 and a lens 14 enclosing the light source assembly 16. The reflector 12 and lens 14 may be formed of either glass or plastic as is well known in the lamp forming art. Also, the reflector 12 has a parabolic reflective surface 18 with a bright metallic deposit for directional control of the light rays emitted by the filament 20. Reflector 12 is provided with corner seating pads 11 on the rear surface of the reflector sealing flange 9. As shown, these pads 11 are of limited height and mass, and, since they are not formed on the body portion of the reflector 12, points of thermal stress inherent in the usual design are eliminated. Also, instead of forming one of the pads 11 with a substantially larger area than the remaining pads for lamp orienting purposes, we prefer to use at least one orienting tang 8 formed off-center on the rear surface of the reflector 12. Although not shown, the lens 14 includes the usual optical flutes and facets for imparting directional control to light rays projected by the reflector 12. Aiming pads 17 are provided on the front surface of the lens 14 and are of significantly shorter height than the aiming pads normally used. The pads 17 are formed as short as possible while being long enough to enable the establishment of an aiming plane since there is no need for grinding off their ends. The aim of the lamp 10 is achieved at the same time the light assembly 16 is oriented with respect to the reflector 12, the lamp envelope being oriented to obtain the desired aim by use of known equipment gaged to the lens aiming pads 17. This allows the height of the aiming pads 17 to be reduced thus significantly reducing the number of lamp rejects due to breaking during grinding and handling.

The lens 14 and the reflector 12 are joined at their peripheral flanges to form a leak-proof seal. As shown, a ridge or lip 15 is formed on the peripheral flange 9 of the reflector 12, alternatively on the flange 13 of lens 14, and a seal is obtained by any suitable means such as ultrasonic welding, flame sealing or use of adhesive, e.g., an epoxy or polyester based adhesive, or glass adhesive. Structurally, any suitable mating design may be used, e.g., the lip-flange design shown or a lip-channel design such as that shown in U.S. Pat. No. 3,625,796.

The light source assembly 16 is structurally joined to the reflector 12 by means of terminals 27 sealed on the rear of the reflector 12 as shown in the drawings. The inner surfaces of the assembled components define a sealed lamp envelope having a controlled environment of inert and/or dry gas.

The light source assembly 16 consists of filament 20, shown in FIG. 1 as contained in a bulb 21, e.g., a tungsten-halogen bulb, a pair of terminals 27, and a pair of lead wires 30, 32 connected to the ends of filament 20 and extending through the pinch portion 22 of bulb 21 for electrical connection with their respective terminals 27.

As shown in FIG. 1, the terminals 27 are formed with an outer end blade portion 34 adapted for interconnection with a suitable power source, the inner end being provided with a plurality of tabs 36 and 37 to which lead wires 30 and 32 are respectively crimped for electrical and mechanical interconnection. Other suitable means such as spot welding and the use of a separate support wire 31, support straps, tabs or projections in the bulb pinch portion may be used. While a single filament bulb is shown, it should be understood that a two filament bulb well known in the art may also be used, the third wire being electrically connected to a third terminal sealed within the reflector in the same manner as described herein.

As shown in the drawings, the rear central portion of reflector 12 is formed to provide a plurality of openings 29 through which the outer ends 34 of terminals 27 extend. Tabs 35 may be formed on the terminals to prevent them from falling through the openings once they are passed therethrough. As shown in FIG. 1, the rear of the reflector 12 through which the terminals 27 are passed is thickened and the openings 29 are provided in concavities or recesses formed in both the inner and outer reflector surfaces with their bottom surfaces closely spaced apart to form a relatively thin section 33 in the reflector 12 about the terminals 27 to enable the rocking movement of the terminals during assembly. The reflector 12 is also provided with evacuating means, shown as a sealed-off evacuating tube 26. As shown, the light source assembly 16 is supported in reflector 12 by the sealing adhesive 43, the correct positioning of bulb 21 and its filament 20 for obtaining the desired light pattern and aim being obtained in the manner described herein.

The width of the section 33 closely surrounding the terminals 27 is maintained sufficiently thin to enable rocking movement of the terminals for ready adjustment of the filament 20 with respect to the reflector 12 in the up-down (Y-Y) and sideways (X-X) directions, adjustment in the longitudinal or front-rear (Z-Z) direction being achieved by the front-rear movement of the terminals 27 through the openings 29. While the adjustment of the light source assembly may be accomplished before or after sealing the lens 14 on the face of reflector 12 during assembly in a machine of the type known in the art, we prefer to accomplish adjustment after sealing the lens 14 on the reflector 12. Upon achieving the desired lighting pattern, the adhesive is activated, e.g., by ultraviolet light, heat, or other suitable means, and the position of the light source assembly 16 is fixed with respect to reflector 12.

In the assembly of the lamp 10 shown in FIG. 1, the terminals 27 are fixtured to maintain the specified positioning for each terminal, this being accomplished using mechanisms well known in the art. The bulb 21 is then electrically connected to and mechanically supported on terminals 27 by securing the lead wires 30 and 32 of the bulb to tabs 36 and 37 to form light source assembly 16. Assembly 16 is positioned in reflector 12 with blade portions 34 extending through the openings 29, this combination being then loaded into an assembly fixture. The lens 14 is then positioned on the reflector 12 and a sealing bond is effected between the two in any suitable manner, e.g., flame sealing or by using the adhesive 43 as previously described. The sealing adhesive 43 is then dispensed in predetermined amount into the recesses about openings 29 on the surface of reflector 12 and about blade portions 34. As noted above, any suitable adhesive may be used, but we prefer to use an ultraviolet light activated polyester based adhesive such as Loctite 352 (modified) ® or LO-727 ® available from Loctite Corporation, Newington, Conn. Also, while the sequence is described as dispensing adhesive prior to adjustment of the bulb position, this may be performed after such adjustment and reference to the one is intended to include the other. Bulb 21 is lit and the light source assembly 16 is moved by the assembly fixture in the X-Y-Z directions. The proper adjustment is determined by optical sensors when the predetermined optical optimum position producing the desired lighting pattern is achieved. The lamp 10 is also aimed at the same time in accordance with applicable lighting standards. The adjusted light source assembly 16 is then subjected to the activating or setting ultraviolet light to effect the adhesive cure. Since all component parts affecting the optical pattern are in place at the time of adjustment, this operation compensates for all variations between the optical components with resultant cost and quality benefits and is preferred. The sealed envelope formed by the lens 14 and reflector 12 is then exhausted and/or flushed through the fill opening, tube 26, a replacement fill of inert and/or dry gas being provided, after which the tube is sealed.

Figure 2:
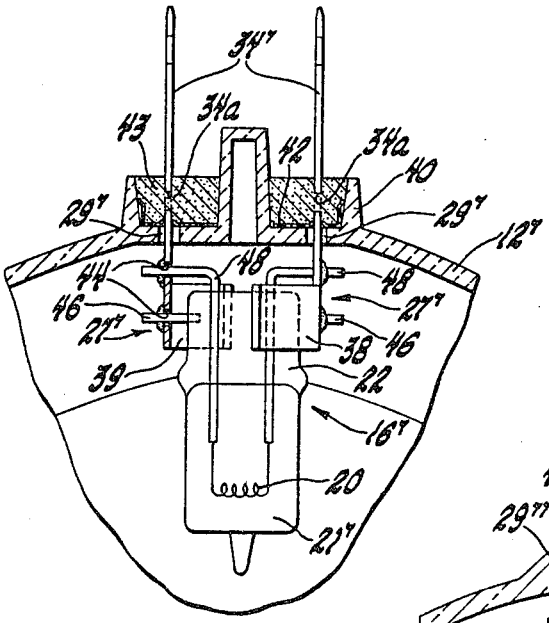
FIG. 2 is a broken-away view similar to FIG. 1 showing modifications of the light source assembly and the reflector construction.
Figure 3:
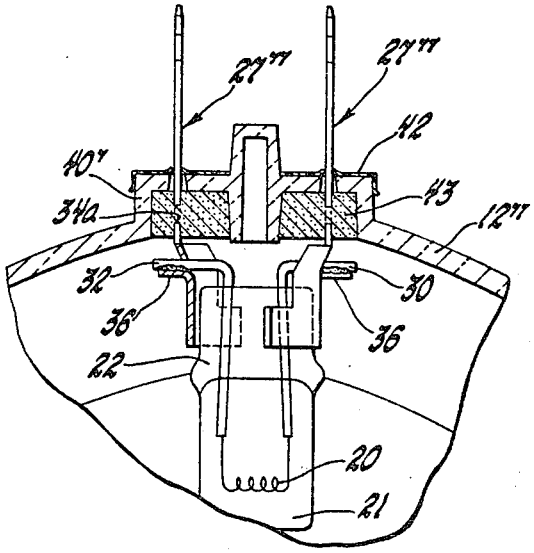
FIG. 3 is a view similar to FIG. 2 showing further modifications of the reflector and light source assembly construction.
Figure 4:
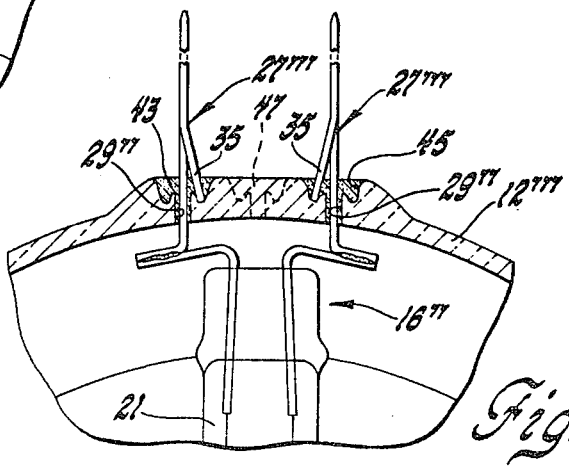
FIG. 4 is a view similar to FIG. 2 showing the preferred embodiment of the reflector and light source assembly construction.

While we have described our invention in terms of the embodiment shown in FIG. 1, modifications of the reflector and light source assembly are shown in FIGS. 2, 3 and 4.

In FIG. 2 the reflector 12′ is formed with a cup-shaped portion or recess 40 at the rear thereof and on its outer surface. The openings 29′ through which the blade portions 34′ of terminals 27′ extend are within the cup-shaped or recess portion 40 and are large enough to permit adjustment of the light source assembly 16′ in the up-down and sideways directions for obtaining the aim of the lamp and the optimum optical positioning with respect to reflector 12′. The adhesive 43, as previously described, is used to fix the position of assembly 16′ in the adjusted position. Holes 34*a* are shown in terminal blade portions 34′ to improve the anchoring of the terminals in the cement. A retainer shield 42 is positioned in recess portion 40 to fit closely about terminal blade portions 34′ to prevent flow of the adhesive 43 into the reflector. Shield 42 may alternatively be positioned on the inner surface of reflector 12′ or may be omitted if appropriate.

Also in FIG. 2, the terminals 27′ are shown as having their inner ends formed by bending to provide clips 38 and 39, the latter shown broken away, similar to those disclosed in our U.S. Pat. No. 4,310,772 for supporting the pinch portion of bulb 21′. The inner end of each terminal 27′ is provided with spaced holes 44 in which support wires 46 and lead wires 48 are positioned and securely attached, e.g., spot welded, soldered, brazed and/or clamped to form good support and electrical interconnections. All other features of the lamp are as previously described.

FIG. 3 shows a further modification of the reflector and light source assembly. As seen in FIG. 3 the cup-shaped or recess portion 40′ is formed on the inner surface of reflector 12″. Also, the shield 42 is shown on the outer surface of reflector 12″ but may be alternatively located on the inner surface in portion 40′. The bulb 21 is electrically interconnected with and supported by the terminals 27″ by means of tabs 36 to which the lead wires 30 and 32 are spot welded or brazed in the same manner as shown in applicants' U.S. Pat. No. 4,310,772. All other features of the lamp are as previously described.

FIG. 4 shows the preferred embodiment of our invention wherein the rear of the reflector 12‴ through which the terminals 27‴ are passed is thickened and the openings 29″ are provided in an annular recess 45, or in separate recesses formed about each opening, the openings conforming to the shape of the terminals passing therethrough and being large enough to permit adjustment of the light source assembly 16″ in the X, Y and Z directions as described. The adhesive 43 is positioned in the recess 45 about terminals 27‴ to achieve a seal in openings 29″. The bulb 21 is electrically interconnected with and supported by the inner end of terminals 27‴ which may be crimped and/or welded about the end of lead wires 30 and 32. This terminal-lead-in wire configuration is preferred as being most economical and reliable. Evacuation or flushing and refill of the lamp envelope is achieved through fill opening 47, in the rear of the reflector, this being plugged by a sealing adhesive such as that described herein. The method of assembly is the same as previously described in connection with the lamp 10 of FIG. 1 and all other lamp features are as previously described.

Figure 5:
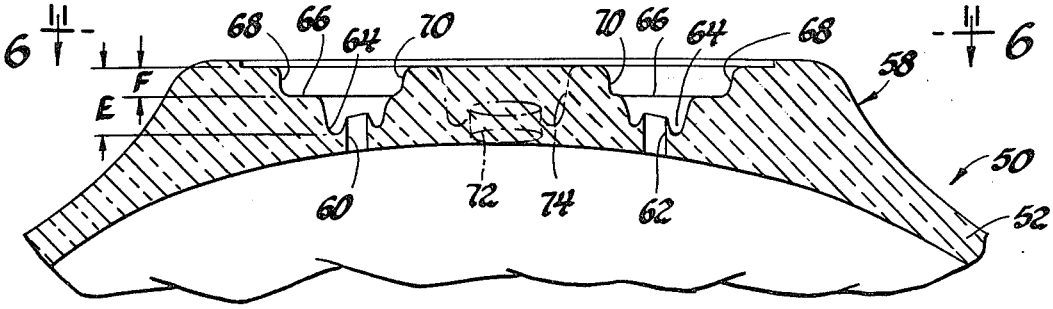
FIG. 5 is an enlarged view of the rear central portion of a reflector similar to the reflector shown in FIG. 4.
Figure 6:
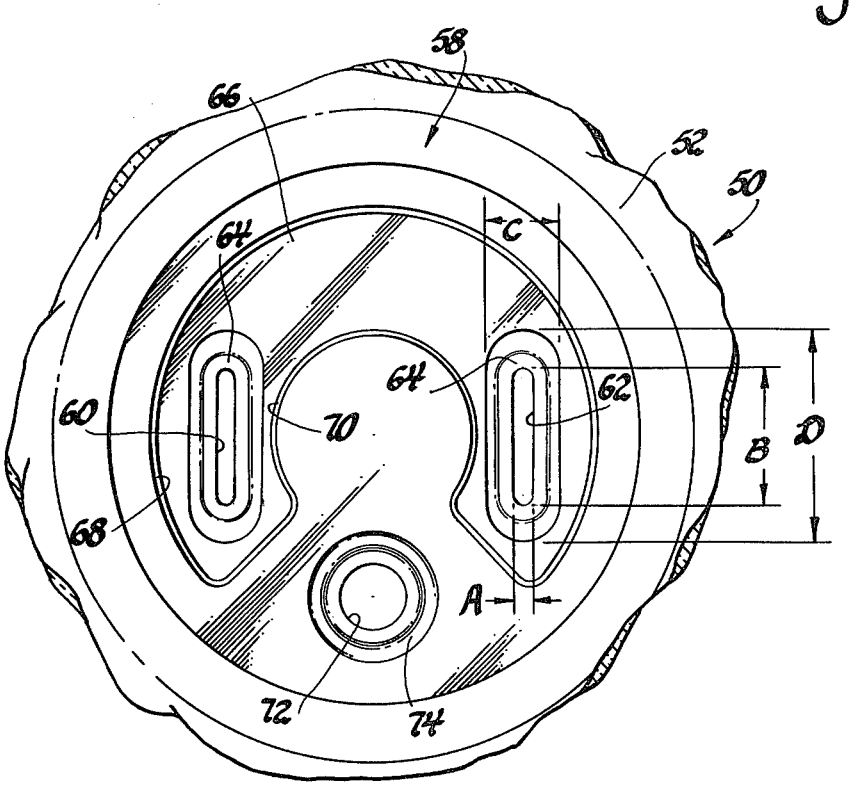
FIG. 6 is a plan view of the rear central portion of the reflector of FIG. 5 taken on line 6—6 thereof.
Figure 7:
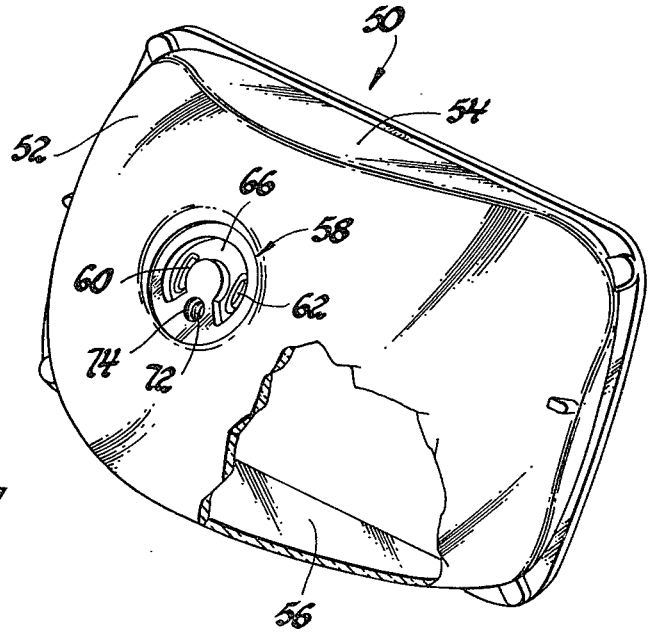
FIG. 7 is a rear perspective view of a reflector incorporating the rear central portion shown in FIGS. 5 and 6.

FIGS. 5–7 show a reflector 50 which is a slightly modified form of the reflector 12‴ illustrated in FIG. 4. In this regard, it will be noted that, as in the case with the reflector 12‴, the reflector 50 comprises a parabolic reflective portion 52 integrally formed with a pair of generally flat upper and lower parallel wall portions 54 and 56, respectively. The rear central portion of the reflector 50 is formed with a boss or circular thickened section 58 which is integral with the parabolic reflective portion 52 and has a pair of identical slots or openings 60 and 62 each of which, as seen in FIG. 5, is surrounded by a substantially U-shaped groove or recess 64 formed in the outer reflector surface. As seen in FIG. 6, the openings 60 and 62 are the same in configuration as the cross-sectional configuration of the blade portions 34 of the terminals 27‴ and are sized to be slightly larger than such cross-sectional configuration so as to enable rocking movement of the terminals 27‴ during the aiming operation of the light source assembly 16″. The openings 60, 62 and the recesses 64 are located in a C-shaped cavity 66 (see FIG. 6) which together with the recesses 64 serves to laterally constrain the adhesive deposited about the terminals 27‴. In other words, sufficient adhesive is dispensed into the recess 64 to fill the cavity 66 so that after the adhesive is activated as aforedescribed, the hardened adhesive bonds the terminals 27‴ to the thickened section 58 of the reflector 50. At the same time, the side walls 68 and 70 of the cavity 66 laterally confine the hardened adhesive so as to strengthen the connection between the terminal and the reflector.

As seen in FIGS. 5–7, the thickened section 58 of the reflector 50 is also formed with a circular opening 72 through which evacuation or flushing and refill of the lamp envelope can be achieved. The opening 72 is also surrounded by a concavity or recess 74 and can be plugged by a sealing adhesive such as that described above.

A reflector such as the reflector 50 shown in FIGS. 5–7 has been successfully utilized for supporting a light source assembly in which the blade portion of each of the terminals located in the accommodating opening 60 or 62 measured 0.76 mm in thickness and 7.72 mm in width. Each opening 60 and 62, as seen in FIG. 5, had a depth measurement of approximately 2.00 mm. With reference to FIGS. 6 and 7, each recess 64 and the cavity 66 had the following dimensions:

A=1.70 mm
B=9.00 mm
C=3.96 mm
D=11.83 mm
E=3.45 mm
F=1.50 mm

Various changes and modifications can be made in this construction without departing from the spirit of the invention. Such changes and modifications are contemplated by the inventors and they do not wish to be limited except by the scope of the appended claims.

The embodiments of the invention in which an exclusive property or privilege is claimed are defined as follows:

1. A reflector for supporting a tungsten-halogen lamp assembly having a light bulb connected to a plurality of terminals, said reflector including a parabolic reflective portion integrally formed with an upper wall and a lower wall, the rear central portion of said parabolic reflective portion being integrally formed with a boss having a substantially uniform thickness greater than the thickness of said parabolic reflective portion adjacent said boss, at least two cavities formed in the exterior portion of said boss; an opening formed in each of said cavities for receiving one of said terminals, each of said cavities being generally concave and stepped in cross-section and totally surrounds the associated opening, each of said openings being sized slightly larger than the cross-sectional configuration of said one of said terminals for allowing pivotal movement of said lamp assembly when said lamp assembly is being optically aimed relative to said reflector; said cavities adapted to accommodate an adhesive for fixing said terminals to said reflector after said lamp assembly is optically aimed.

2. A reflector for supporting a tungsten-halogen lamp assembly having a light bulb connected to a plurality of terminals, said reflector including a parabolic reflective portion integrally formed with an upper wall and a lower wall, the rear central portion of said parabolic reflective portion being integrally formed with a boss having a substantially uniform thickness greater than the thickness of said parabolic reflective portion adjacent said boss, at least two cavities formed in the exterior portion of said boss; an opening formed in each of said cavities for receiving one of said terminals, a groove in each of said cavities which is generally concave and U-shaped in cross-section surrounding each of said openings and being located adjacent thereto so as to provide a stepped configuration when each of said cavities is viewed in cross-section, each of said openings being sized slightly larger than the cross-sectional configuration of said one of said terminals for allowing pivotal movement of said lamp assembly when said lamp assembly is being optically aimed relative to said reflector; each of said cavities adapted to accommodate an adhesive for fixing said terminals to said reflector after said lamp assembly is optically aimed.

3. A reflector for supporting a tungsten-halogen lamp assembly having a light bulb connected to a plurality of terminals, said reflector including a parabolic reflective portion integrally formed with an upper wall and a lower wall, the rear central portion of said parabolic reflective portion being integrally formed with a boss having a substantially uniform thickness greater than the thickness of said parabolic reflective portion adjacent said boss, a first cavity formed in the exterior portion of said boss; a pair of second cavities formed in said first cavity, a slot formed in each of said second cavities for receiving one of said terminals, each of said second cavities being generally concave in cross-section, a U-shaped groove located in said each of said second cavities and totally surrounding the associated slot closely adjacent thereto so as to provide a stepped configuration when said each of said second cavities is viewed in cross-section, each of said slots being sized slightly larger than the cross-sectional configuration of said one of said terminals for allowing pivotal movement of said lamp assembly when said lamp assembly is being optically aimed relative to said reflector; said first and second cavities adapted to accommodate an adhesive for fixing said terminals to said reflector after said lamp assembly is optically aimed.

* * * * *